US007855652B1

(12) United States Patent
Giovannelli et al.

(10) Patent No.: US 7,855,652 B1
(45) Date of Patent: Dec. 21, 2010

(54) SYSTEM AND METHOD FOR DETECTING SLEEPWALKING

(75) Inventors: Benjamin A. Giovannelli, Delmont, PA (US); Michael E. Colbaugh, Trafford, PA (US); Kevin Wells, Saltsburg, PA (US)

(73) Assignee: RIC Investments, LLC, Wilmington, DE (US)

( * ) Notice: Subject to any disclaimer, the term of this patent is extended or adjusted under 35 U.S.C. 154(b) by 616 days.

(21) Appl. No.: 11/851,656

(22) Filed: Sep. 7, 2007

Related U.S. Application Data

(60) Provisional application No. 60/842,742, filed on Sep. 7, 2006.

(51) Int. Cl.
*G08B 23/00* (2006.01)

(52) U.S. Cl. ..... 340/573.4; 340/573.1; 340/539.23; 340/539.13; 340/539.15

(58) Field of Classification Search ..... 340/573.1, 340/573.4, 539.1, 540, 568.1, 693.1, 825.49, 340/691.6, 539.23, 539.13, 539.15, 539.21; 342/357

See application file for complete search history.

(56) References Cited

U.S. PATENT DOCUMENTS 5,963,137 A 10/1999 Waters, Sr.
6,088,595 A * 7/2000 Ciccone et al. ..... 455/463
6,289,237 B1 * 9/2001 Mickle et al. ..... 600/509
6,825,767 B2 * 11/2004 Humbard ..... 340/573.1

* cited by examiner

*Primary Examiner*—Anh V La
(74) *Attorney, Agent, or Firm*—Timothy A. Nathan

(57) ABSTRACT

A system and method of detecting possible sleepwalking episodes that include generating one or more signals indicative of the movement of an individual while sleeping, determining whether the movement signals indicate a possible sleepwalking episode, causing one or more motion based alert signals to be emitted if the movement signals do indicate a possible episode, monitoring a proximity of the individual to a position within a sleeping environment, and causing one or more proximity based alert signals to be emitted when the individual is determined to be at least a certain distance away from the position.

30 Claims, 7 Drawing Sheets

SYSTEM AND METHOD FOR DETECTING SLEEPWALKING

CROSS-REFERENCE TO RELATED APPLICATIONS

This application claims priority under 35 U.S.C. §119(e) from provisional U.S. patent application No. 60/842,742 filed Sep. 7, 2006 the contents of which are incorporated herein by reference.

BACKGROUND OF THE INVENTION

1. Field of the Invention

The present invention relates to sleepwalking, and in particular to a system and method for detecting possible sleepwalking episodes and providing one or more alerts and/or mitigating one or more control actions when a possible sleepwalking episode has been detected.

2. Description of the Related Art

Sleepwalking (also called noctambulism or somnambulism) is a sleep disorder in which an individual engages in activities while asleep or in a sleeplike state that are normally associated with wakefulness. Such activities may include, for example, walking, dressing, eating, or even driving a car. Sleepwalking is most prevalent in pre-adolescent individuals, although it can affect people of any age. Because a sleepwalker typically remains in a deep (unconscious) sleep state throughout the episode, he or she may be difficult to awaken and will probably not remember the sleepwalking incident. Thus, while sleepwalking itself does not inherently pose a serious health concern to those who experience it, the absence of full arousal and full awareness during sleepwalking episodes does present a significant risk of injury to the individual or others as a result of accidents that may occur. For obvious reasons, this risk of injury is of great concern to parents of child sleepwalkers and to other caregivers in general.

U.S. Pat. No. 5,963,137 describes a system for monitoring the movement of an individual, such as a sleepwalker, that provides an alarm signal when a sleep-time excursion form bed is detected. The system employs a magnetic switch that is coupled to an audible and visual alarm system and a connecting strap that is fitted on one end to the individual being monitored by a standard clothing suspender fastener and on the other end to the magnetic switch by way of a hook assembly. The magnetic switch houses a solid magnetic cylinder which, when separated from the other half of the switch as a result of the forward or side displacement of the individual, and thus the strap and hook assembly, opens the circuit and activates the alarm system.

While the system described in U.S. Pat. No. 5,963,137 provides a solution for monitoring the movement of an individual, such as a sleepwalker, that may be effective under certain conditions, it requires that the individual being monitored be physically tethered to the alarm activating mechanism. Such physical tethering is uncomfortable as it greatly restricts the freedom of movement during sleep, possibly to the extent of adversely affecting that individual's sleep. In addition, the system described in U.S. Pat. No. 5,963,137 only guards against a simple type of movement, i.e., a simple displacement of the individual being monitored that would cause the tethering mechanism to become disconnected. It does not measure more meaningful and precise movement information (other then a simple displacement) to give a caregiver options to better define permitted and prohibited movements. Thus, there is a need for a system that is able to detect sleepwalking episodes without greatly restricting the freedom of movement of that individual being monitored that also measures more meaningful and precise movement information of the individual being monitored.

SUMMARY OF THE INVENTION

In one embodiment, the invention provides a system for detecting possible sleepwalking episodes of an individual by monitoring both the movement of the individual and the proximity of the individual to a particular location within the room or other environment where the individual sleeps. The system includes a monitoring unit structured to be worn by the individual while the individual is sleeping and a base unit positioned within an environment where the individual sleeps. The monitoring unit has a first processing unit and a motion sensor in electronic communication with the first processing unit. The motion sensor generates one or more signals indicative of the movement of the individual, and the first processing unit causes one or more motion based alert signals to be emitted by the system when the first processing unit determines that the one or more signals indicative of the movement of the individual indicate a possible sleepwalking episode. The motion based alert signals may be emitted by any combination of one or more of the monitoring unit, the base unit and a caregiver unit having a caregiver processing unit and one or more caregiver alert mechanisms that may form a part of the system. In addition, at least one of the monitoring unit and the base unit causes one or more proximity based alert signals to be emitted by the system when the monitoring unit is determined to be at least a certain distance away from the base unit.

In one particular embodiment, the first processing unit generates motion data based upon the one or more signals indicative of the movement of the individual, in which case the first processing unit determines whether the one or more signals indicative of the movement of the individual indicate a possible sleepwalking episode based upon the motion data. For example, the first processing unit may determine that the one or more signals indicative of the movement of the individual indicate a possible sleepwalking episode when the motion data is determined to exceed a certain value. The motion data may represent, for example, a distance traveled by the individual, a velocity of the individual, an acceleration of the individual, an angular movement of the individual and/or a location of the individual.

As noted above, the system, in one aspect, detects possible sleepwalking episodes by monitoring the proximity of the monitoring unit, and thus the individual, to the base unit. In one particular embodiment, the monitoring unit has a first wireless communications device and the base unit has a second wireless communications device. One of the first wireless communications device and the second wireless communications device emits a beacon signal and the other of the first wireless communications device and the second wireless communications device is structured to receive the beacon signal. At least one of the monitoring unit and the base unit are adapted to determine that the monitoring unit is at least the certain distance away from the base unit and cause the one or more proximity based alert signals to be emitted when the signal strength of the received beacon signal is determined to be at or below a predetermined value as the signal strength is indicative of a distance between the monitoring unit and the base unit.

In one particular implementation of the above described embodiment, the first wireless communications device emits the beacon signal and the second wireless communications device is structured to receive the beacon signal. The base unit in this implementation may include a second processing unit and one or more base unit alert mechanisms, wherein the second processing unit is adapted to determine the signal strength of the received beacon signal and cause the one or more base unit alert mechanisms to emit a first one or more of the one or more proximity based alert signals when the signal strength is determined to be at or below the predetermined value. The predetermined value may be about zero, in which case the system detects when the monitoring unit and the base unit are out of range with one another. The monitoring unit in this implementation may include a one or more monitoring unit alert mechanisms, in which case the second processing unit is adapted to cause the second wireless communications device to transmit a wireless alert signal to the first wireless communications device when the signal strength of the beacon signal is determined to be at or below the predetermined value. In response to receipt of the wireless alert signal, the first processing unit is adapted to cause the one or more monitoring unit alert mechanisms to emit one or more alert signals.

As noted above, the system may also include a caregiver unit having a caregiver processing unit and one or more caregiver alert mechanisms. In this implementation, the second processing unit (i.e., of the base unit) is adapted to cause an alert signal to be transmitted, wired or wirelessly, to the caregiver unit when the signal strength of the beacon signal is determined to be at or below the predetermined value. In response to receipt of the alert signal, the caregiver processing unit is adapted to cause the one or more caregiver alert mechanisms to emit one or more alert signals.

In another embodiment, the second processing unit (i.e., of the base unit) is adapted to cause a power line signal to be transmitted over the power lines of a structure in which the base unit is located when the signal strength of the beacon signal is determined to be at or below the predetermined value. The power line signal may be transmitted based upon, for example, X10 technology. The power line signal causes one or more devices, such as a light or lights, a television, a stereo system, a clock radio or some other device that can emit a humanly perceptible (e.g., audible) alarm, that are coupled to the power lines to be controlled in a predetermined manner (e.g., turned on so as to create a human perceptible alarm). Alternatively, the monitoring unit or the base unit may be adapted to transmit a signal to an installed house control system (such as a security system), which in turn would cause a humanly perceptible (e.g., audible) alarm to be generated (much in the way that known panic buttons in home security systems cause alarms to be generated).

In yet another embodiment, GPS is used to determine when the monitoring unit is at least a certain distance away from the base unit. In particular, the monitoring unit further includes a GPS unit that receives global positioning information that indicates a current location of the monitoring unit. The monitoring unit transmits the global positioning information to the base unit, and the base unit determines whether the monitoring unit is at least a certain distance away from the base unit based upon the global positioning information.

In still a further embodiment, one or more boundary units are used to determine when the monitoring unit is at least a certain distance away from the base unit. Specifically, in this embodiment, the system further includes at least one boundary unit provided at least one boundary position of the environment in which the individual being monitored sleeps. The monitoring unit is determined to be at least a certain distance away from the base unit when the monitoring unit is within a second certain distance of the at least one boundary unit. In particular, the at least one boundary unit emits a boundary signal, and wherein the monitoring unit is determined to be within the second certain distance when the monitoring unit is able to receive the boundary signal.

In another embodiment, the invention provides a method of detecting possible sleepwalking episodes of an individual that includes generating one or more signals indicative of the movement of the individual while the individual is sleeping, determining whether the one or more signals indicative of the movement of the individual indicate a possible sleepwalking episode, causing one or more motion based alert signals to be emitted if it is determined that the one or more signals indicative of the movement of the individual indicate a possible sleepwalking episode, monitoring a proximity of the individual to a position within an environment where the individual sleeps, and causing one or more proximity based alert signals to be emitted when the individual is determined to be at least a certain distance away from the position.

The step of monitoring a proximity of the individual may include wirelessly transmitting a beacon signal from one of a monitoring unit worn by the individual and a base unit located at the position, wirelessly receiving the beacon signal at the other of the monitoring unit and the base unit, and determining that the individual is at least the certain distance away from the position when a signal strength of the beacon signal received by the other of the monitoring unit and the base unit is determined to be at or below a predetermined value. Alternatively, the step of monitoring a proximity of the individual to a position within an environment where the individual sleeps may include employing global positioning to monitor a location of the individual. As still another alternative, the step of monitoring a proximity of the individual to a position within an environment where the individual sleeps may include monitoring whether the individual is within a certain distance of at least one boundary unit provided at least one boundary position of the environment.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE EXEMPLARY EMBODIMENTS

Figure 1:
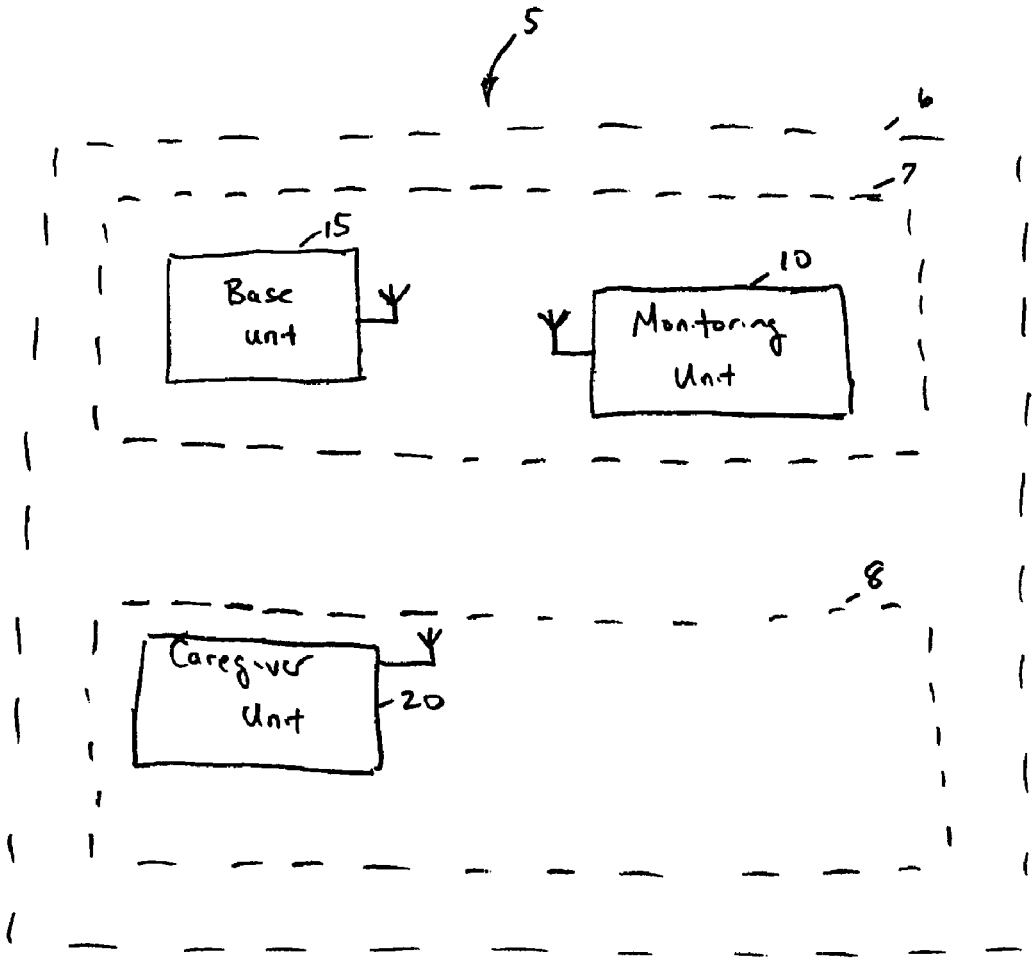
FIG. 1 is a block diagram of a system for detecting sleepwalking episodes and providing an alert signal or signals in response thereto according one particular embodiment of the present invention.

FIG. 1 is a block diagram of a system 5 for detecting sleepwalking episodes and providing an alert signal or signals in response thereto according one particular embodiment of the present invention. The system 5 is preferably implemented in a structure 6, such as a home, in which an individual, such as a child or some other person who may be prone to sleepwalking, and a caregiver for the individual, such as a parent, typically sleeps. The system 5 includes a monitoring unit 10 that is structured to be worn or otherwise carried by the individual that is being monitored by the system 5. For example, the monitoring unit 10 may be structured to be readily attached to a garment worn by the individual, such as through a suitable clipping mechanism, or may be structured to be directly attached to the body of the individual, such as through a strap that wraps around a portion of the individual's body (e.g., the individual's wrist, arm, ankle or leg). The monitoring unit 10 may even be worn by being implanted in the body of the individual to be monitored. For convenience, the terms "wear", "wears" and "worn" shall be used herein to refer to all instances of wearing or otherwise carrying the monitoring unit 10. The system 5 also includes a base unit 15 that is located in a stationary position in the room 7 or other location within the structure 6 where the individual being monitored sleeps. For example, the base unit 15 may be located on a nightstand or some other piece of furniture adjacent to the individual's bed in the individual's room 7. The system 5 shown in FIG. 1 also includes a caregiver unit 20 that is located in a location selected by the caregiver of the individual being monitored. For example, as shown in FIG. 1, the caregiver unit 20 may be located in the room 8 or other location within the structure 6 where the caregiver typically sleeps.

Figure 2:
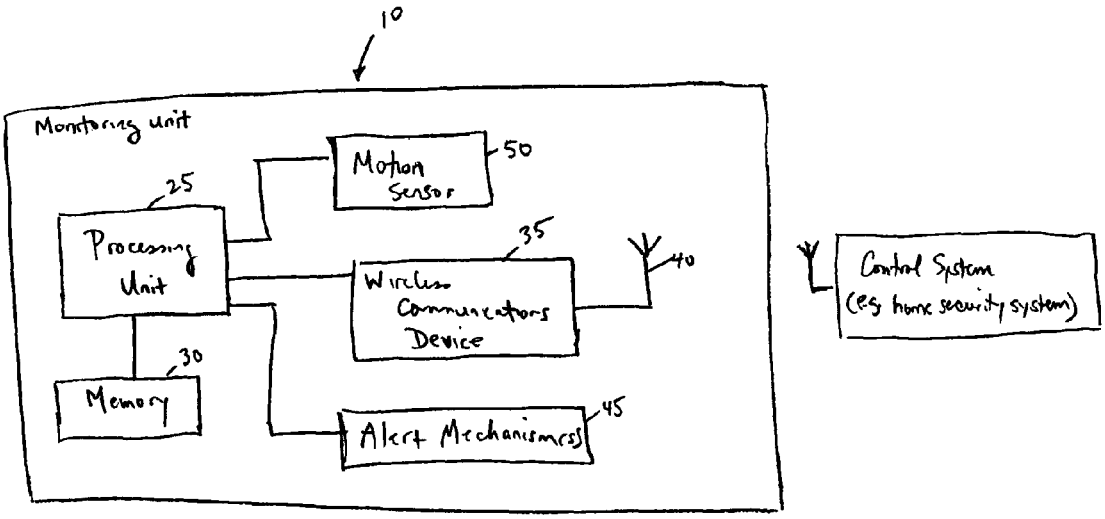
FIG. 2 is a block diagram of one particular embodiment of the monitoring unit forming a part of the system shown in FIG. 1.

FIG. 2 is a block diagram of one particular embodiment of the monitoring unit 10. As seen in FIG. 2, the monitoring unit 10 includes a processing unit 25, which may be, without limitation, a microprocessor, a microcontroller or another suitable computer processing device. The monitoring unit 10 also includes a memory 30 which is in electronic communication with the processing unit 25. The memory 30 can be any of a variety of storage devices such as, for example and without limitation, RAM, ROM, EPROM, EEPROM, and/or other devices, and may be separate from the processing unit 25 (as shown) or, alternatively, a part of the processing unit 25. The memory 30 stores a number of routines which are executable by the processing unit 25 in order to provide the functionality described herein. A wireless communications device 35, operatively coupled to a suitable antenna 40, is in electronic communication with the processing unit 25. The wireless communications device 25 and the antenna 40 enable the monitoring unit 10 to communicate wirelessly with the base unit 15 using a suitable wireless communications protocol. Preferably, an RF communications protocol is employed, in which case the wireless communications device 35 may be an RF transceiver device (a separate RF transmitter and/or receiver unit may also be used). It should be understood, however, that other wireless protocols, such as, without limitation, protocols based on ultrasonic, infrared, or near-field magnetic signals may also be used without departing from the scope of the present invention.

One or more alert mechanisms 45 are also provided as part of the monitoring unit 10 and are in electronic communication with and under the control of the processing unit 25. The alert mechanisms 45 may include an audible alert mechanism, such as a buzzer, a bell or a tone generator, or a visual alert mechanism, such as a static or flashing light. As described elsewhere herein, the alert mechanisms 45 are included to provide an alert signal when possible sleep walking episodes are detected.

Finally, the monitoring unit 10 includes a motion sensor 50 in electronic communication with the processing unit 25 which detects movement by the individual that is being monitored, which movement may be indicative of a sleepwalking episode being experienced by the individual. For example, the motion sensor 50 may be an accelerometer, which, as is known, is an instrument that includes a transducer which converts mechanical motion into an electrical signal that is proportional to the acceleration value of the motion. In this embodiment, the electrical signal that is output by the accelerometer is provided to the processing unit 25 which, in turn, may use the information contained therein to calculate motion data relating to the individual being monitored, such as, without limitation, a velocity at which the individual is moving or a distance over which the individual has traveled over a given period of time (such as a period beginning with the first detected movement), each of which may be used to indicate sleepwalking episodes. Alternatively, the motion sensor 50 may be a gyroscope, which, as is known, is an instrument that is used to detect angular movement. In this embodiment, the signal output by the gyroscope is provided to the processing unit 25 and may be used thereby to monitor the degree of or nature of the movement of the individual being monitored, which in turn may be used to indicate the existence of a possible sleepwalking episode.

Figure 3:
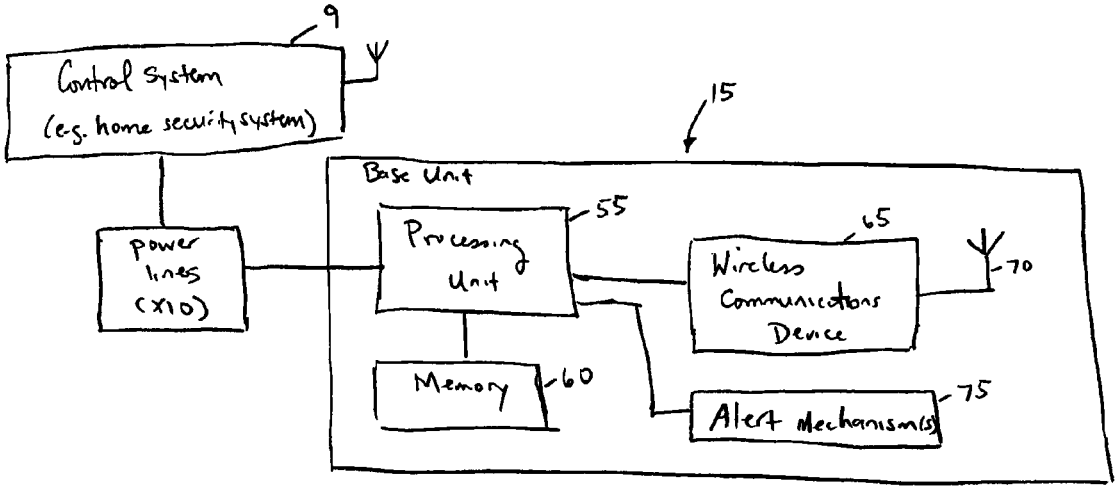
FIG. 3 is a block diagram of one particular embodiment of the base unit forming a part of the system shown in FIG. 1.

FIG. 3 is a block diagram of one particular embodiment of the base unit 15 shown in FIG. 1. As seen in FIG. 3, the base unit 15 is similar to the monitoring unit 10 as it includes a number of similar components. The base unit 15 includes a processing unit 55, which may be, without limitation, a microprocessor, a microcontroller or another suitable computer processing device, and a memory 60 which is in electronic communication with the processing unit 55 and which can be any of a variety of storage devices such as, for example and without limitation, RAM, ROM, EPROM, EEPROM, and/or other devices, and may be separate from the processing unit 55 (as shown) or, alternatively, a part of the processing unit 55. The memory 60 stores a number of routines which are executable by the processing unit 55 in order to provide the functionality described herein. A wireless communications device 65, operatively coupled to a suitable antenna 70, is in electronic communication with the processing unit 55. The wireless communications device 65 and the antenna 70 enable the base unit 15 to communicate wirelessly with the monitoring unit 10 and the caregiver unit 20 using a common suitable wireless communications protocol, such as those described elsewhere herein. In particular, as described in more detail herein, the base unit 15 is able to wirelessly receive a signal from the monitoring unit 10 which indicates that the individual being monitored is likely experiencing a sleepwalking episode. In addition, the base unit 15 includes one or more alert mechanisms 75 which may be similar to the alert mechanisms 45 of the monitoring unit 10 and which are in electronic communication with and under the control of the processing unit 55. The alert mechanisms 75 are included to provide an alert signal in response to the receipt of a signal from the monitoring unit 10 that indicates the detection of a possible sleepwalking episode.

Figure 4:
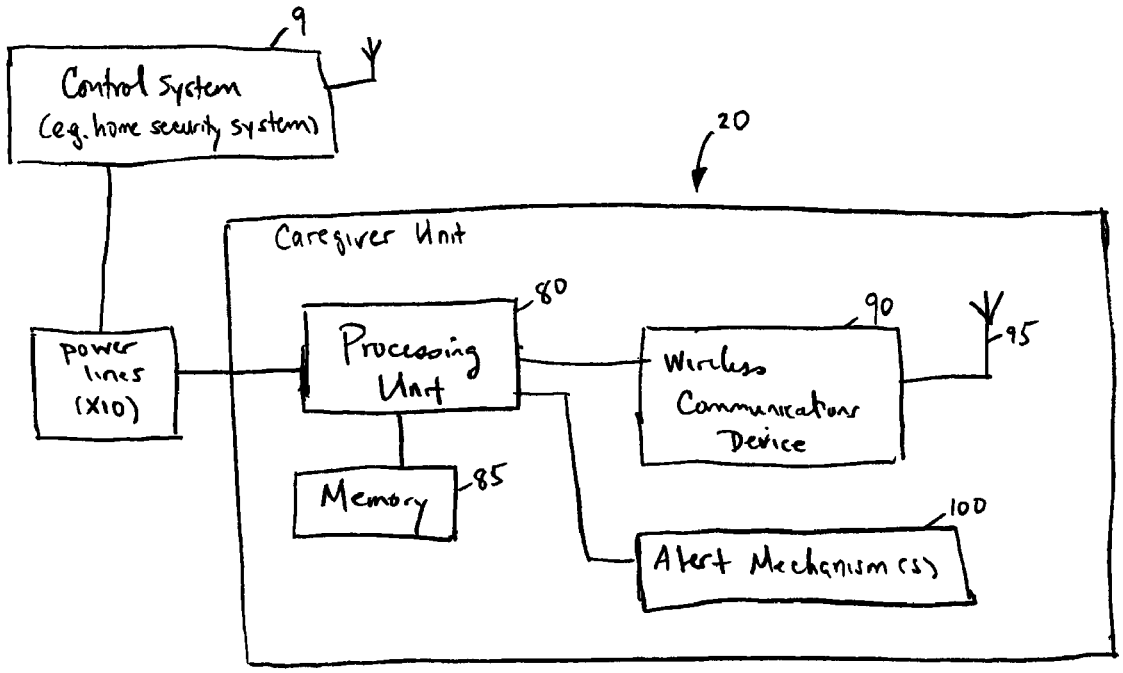
FIG. 4 is a block diagram of one particular embodiment of the caregiver unit forming a part of the system shown in FIG. 1.

FIG. 4 is a block diagram of one particular embodiment of the caregiver unit 20 shown in FIG. 1. As seen in FIG. 4, the caregiver unit 20 is similar to the monitoring unit 10 and the base unit 15 as it includes a number of similar components. The caregiver unit 20 includes a processing unit 80, which may be, without limitation, a microprocessor, a microcontroller or another suitable computer processing device, and a memory 85 which is in electronic communication with the processing unit 80 and which can be any of a variety of storage devices such as, for example and without limitation, RAM, ROM, EPROM, EEPROM, and/or other devices, and may be separate from the processing unit 80 (as shown) or, alternatively, a part of the processing unit 80. The memory 85 stores a number of routines which are executable by the processing unit 80 in order to provide the functionality described herein. A wireless communications device 90, operatively coupled to a suitable antenna 95, is in electronic communication with the processing unit 80. The wireless communications device 90 and the antenna 95 enable the caregiver unit 20 to communicate wirelessly with the base unit 15 using a common suitable wireless communications protocol, such as those described elsewhere herein. In particular, as described in more detail herein, the caregiver unit 20 is able to wirelessly receive a signal from the base unit 15 which indicates that the individual being monitored is likely experiencing a sleepwalking episode. The caregiver unit 20 includes one or more alert mechanisms 100 which may be similar to the alert mechanisms 45 and 75 and which are in electronic communication with and under the control of the processing unit 80. The alert mechanisms 100 are included to provide an alert signal to the caregiver indicating that a potential sleepwalking episode has been detected so that the caregiver can come to the aid of the individual being monitored and thereby reduce the likelihood of injuries resulting form the episode.

According to one embodiment of the present invention, the system 5 detects sleepwalking episodes by monitoring the proximity of the individual to the base unit 15. In particular, the system 5 does so by monitoring the proximity of the monitoring unit 10 worn by the individual to the base unit 15. If the individual (i.e., the monitoring unit 10) is determined to be beyond a certain distance from the base unit 15, the system 5 is adapted to cause the generation of one or more alerts aimed at waking up one or both of the individual or the individual's caregiver. In operation, the individual being monitored activates the monitoring unit 10 and wears the monitoring unit 10 when he or she goes to sleep. In this embodiment, when the monitoring unit 10 is activated, the wireless communications device 35 thereof, under the control of the processing unit 25, emits a wireless beacon signal having a predetermined strength. That beacon signal is intended to be received by the wireless communications device 65 of the base unit 15. The wireless communications device 65 in turn sends the received beacon signal to the processing unit 55 of the base unit 15. The processing unit 55 examines the strength of the received beacon signal. If the strength of the received beacon signal falls below a certain predetermined level, then the processing unit 55 considers the monitoring unit 10 to have moved far enough away from the base unit 15 to warrant an alarm (i.e., a sleepwalking episode may be occurring). As will be appreciated, the strength of the beacon signal and the corresponding predetermined level used to determine when an alert should be issued are chosen (and may be adjustable by the user) based upon the relevant circumstances, such as how far away from the base unit 15 the individual should be allowed to travel before an alert is generated, how that distance will effect the level of the signal that is received by the base unit 15 (i.e., how much loss will occur during the transmission), and other factors relating to the individual sleeping environment, such as bed or room size. In one embodiment, the predetermined level that is chosen is zero. In other words, in that embodiment, the system 5 employs a limited range wireless link and waits until the monitoring unit 10 and the base unit 15 are out of range with one another before an alert is generated. In other embodiments, the predetermined level that is chosen is some percentage of the original signal, such as 10% of the original signal. The relative strength used to trigger an alarm may be selectable by a user from a set of strength values based on the desired boundary and/or interference of the sleeping environment (note that when one is not in an open field with a "perfect" antenna, radio signal strength is affected by attenuation, reflection, constructive/destructive interference, and/or orientation to the antenna). Alternatively, the relative strength used to trigger an alarm could be learned by the system by an initial calibration sequence where the monitoring unit 10 and/or base unit 15 measures the signal strength as the caregiver moves the monitoring unit 10 around the bounded sleeping location once the base unit 15 is positioned. This calibration could establish both a high value and low value, i.e. the monitoring unit 10 should be at least a certain established minimum distance from the base unit 15 (high strength value) but not farther than a maximum established distance from the base unit 15 (low strength value).

The distance and direction of the monitoring unit 10 from the base unit 15 can also be determined by other commonly known methods of radio ranging and direction determination (i.e., other than based on signal strength as described above). For example, a multi-antenna/multi-signal method can be used to determine differential time of flight or differential signal strength. Other examples of common methods include directional antennas, time sequenced transmission to multiple antennas, code division multiplexing with multiple antennas, among many others. The signal strength based methods described above are, however, amongst the most economical and may thus be desirable (but note that they do not include direction).

After making a determination that the monitoring unit 10 has moved far enough away from the base unit 15 to warrant an alarm, the processing unit 55 sends an alert trigger signal to the one or more alert mechanisms 75 which causes the alert mechanisms 75 to generate and emit an appropriate alert signal or signals aimed at awakening the sleepwalking individual and possibly also the caregiver. For example, if the alert mechanisms 75 include an audible alert mechanism, an audible alert will be emitted (e.g., a buzzing sound, a bell sound or a tone), and if the alert mechanisms 75 include a visual alert mechanism, a visual alert will be emitted (e.g., a flashing or static light). The processing unit 55 of the base unit 15 may also, in response to such a determination, send a wireless alert trigger signal to the monitoring unit 10 through the wireless communications device 65 and the antenna 70.

The wireless alert trigger signal will be received by the antenna 40 and the wireless communications device 35 of the monitoring unit 10 and thereafter will be transmitted to the processing unit 25 of the monitoring unit 10. In response thereto, the processing unit 25 sends an alert trigger signal to the one or more alert mechanisms 45 which causes the alert mechanisms 45 to generate and emit an appropriate alert signal or signals, in the manner described above, aimed at awakening the sleepwalking individual and possibly also the caregiver.

In the preferred embodiment of the present invention, the processing unit 55 of the base unit 15 also sends a wireless alert trigger signal to the caregiver unit 20 through the wireless communications device 65 and the antenna 70 when the processing unit 55 makes a determination that the monitoring unit 10 has moved far enough away from the base unit 15 to warrant an alarm. That wireless alert trigger signal will be received by the antenna 95 and the wireless communications device 90 of the caregiver unit 20 and thereafter will be transmitted to the processing unit 80 of the caregiver unit 20. In response thereto, the processing unit 80 sends an alert trigger signal to the one or more alert mechanisms 100 of the caregiver unit 20 which causes the alert mechanisms 100 to generate and emit an appropriate alert signal or signals, in the manner described above, aimed at awakening the caregiver of the sleepwalking individual so that that caregiver can take steps to protect the individual.

Figure 7:
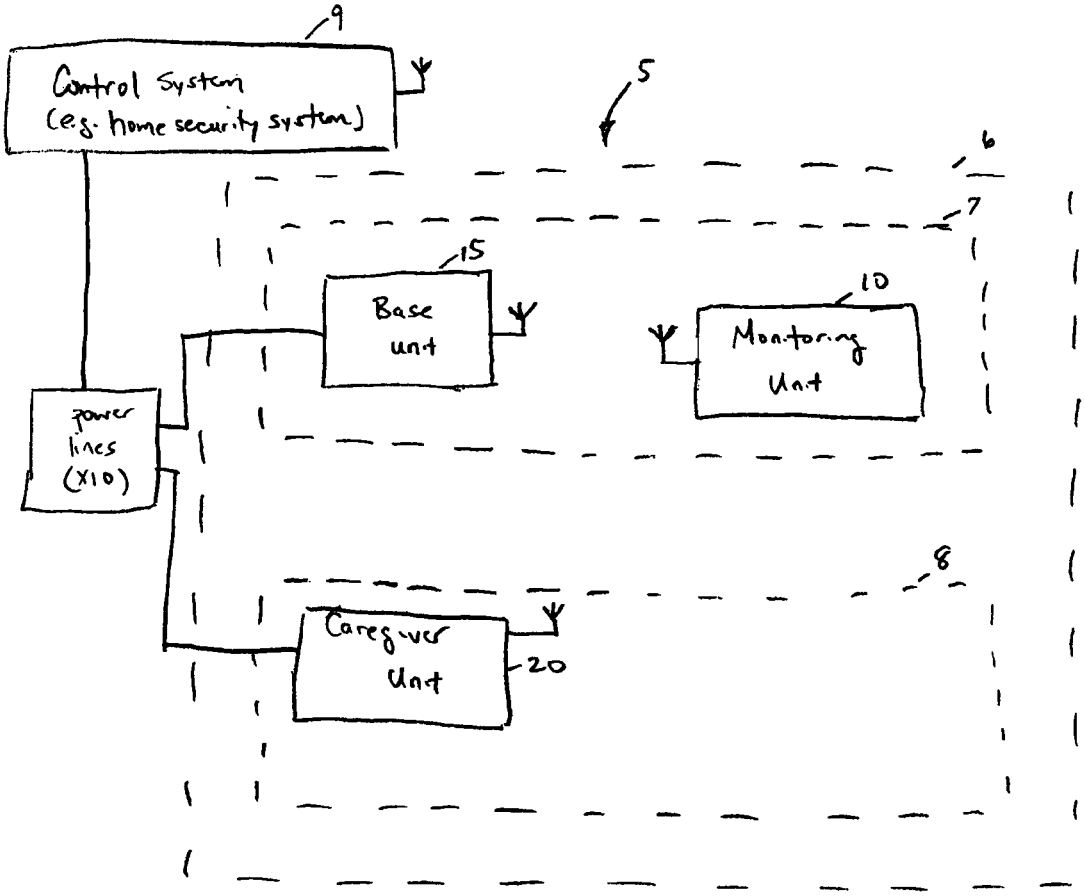
FIG. 7 is a block diagram of a system for detecting sleepwalking episodes and providing an alert signal or signals in response thereto according an alternative embodiment of the present invention wherein the monitoring unit, the base unit or the caregiver unit may be adapted to transmit a signal to an installed control system (such as a home security system).

In an alternative embodiment, as shown in FIGS. 3 and 4, the base unit 15 may be adapted to transmit the alert trigger signal to the caregiver unit 20 in a wired, rather than a wireless, form, such as, for example, through the power lines of the structure 6 in which the individual and the caregiver are located using X10 or similar technology. In addition, in one particular alternative embodiment, when the processing unit 55 of the base unit 15 makes a determination that the monitoring unit 10 has moved far enough away from the base unit 15 to warrant an alarm, the base unit 15 sends a signal through the power lines of the structure 6 using X10 or similar technology which causes the lights in all or selected portions of the structure 6 to be turned on. In addition, other actions within the structure 6, such as turning on a television, a stereo system, a clock radio or the like (or any other predetermined control of a device such as automatically locking a door or window), may be initiated by the same or a similar signal, all of which are aimed at awakening one or both of the individual and the caregiver. Alternatively, as shown in FIG. 7 (and in FIGS. 2, 3 and 4), the monitoring unit 10, the base unit 15 or the caregiver unit 20 may be adapted to transmit a signal (e.g., through power lines or some other hardwired connection or wirelessly) to an installed control system 9 (such as a home security system), which in turn would cause a humanly perceptible (e.g., audible) alarm to be generated (much in the way that known panic buttons in home security systems cause alarms to be generated).

In yet another alternative embodiment, the roles of the monitoring unit 10 and the base unit 15 in the proximity monitoring functionality described hereinabove may be reversed. In particular, in this embodiment, the base unit 15 emits a beacon signal that is received by the monitoring unit 10, and the processing unit 25 of the monitoring unit 10 examines the strength of the received beacon signal. If the strength of the received beacon signal falls below a certain predetermined level, the processing unit 25 considers the monitoring unit 10 to have moved far enough away from the base unit 15 to warrant an alarm (i.e., a sleepwalking episode may be occurring), and thereafter the processing unit 25 sends an alert trigger signal to the one or more alert mechanisms 45 which causes the alert mechanisms 45 to generate and emit an appropriate alert signal or signals aimed at awakening the sleepwalking individual and possibly also the caregiver. The monitoring unit 10 in this embodiment may also send a wireless alert trigger signal to the base unit 15 to cause one or more alerts to be generated by the base unit 15 as described herein. The base unit 15 may in turn send a wireless alert trigger signal to the caregiver unit 20 to cause additional alerts to be generated by the caregiver unit 20 as described herein. Alternatively, the monitoring unit 10 may send a wireless alert trigger signal directly to the caregiver unit 20 rather than through the base unit 15.

According to another aspect of the present invention, the system 5 also detects possible sleepwalking episodes by monitoring the movement of the individual being monitored. Preferably, the motion or movement based monitoring is implemented in addition to the monitoring based on the proximity of the individual to the base unit 15 described above, in which case alerts will be generated when either the motion information or the proximity information indicates the possibility of a sleepwalking episode. In operation, when the individual being monitored wears the monitoring unit 10 while sleeping, the motion sensor 50 thereof, which may be, without limitation, an accelerometer or a gyroscope, sends electronic signals to the processing unit 25 which are indicative of the movement of the individual. After receiving those signals, the processing unit 25 makes a determination as to whether the received signals are indicative of a possible sleepwalking episode. For example, the processing unit 25 may use the signals received from the motion sensor 50 to calculate motion data such as, without limitation, a velocity at which the individual is moving, an acceleration or an angular movement (tilt) value for the individual, or a distance over which the individual has traveled over a given period of time (such as a period beginning with the first detected movement). The calculated motion data is then compared to certain predetermined stored parameters to determine whether an alert for a possible sleepwalking episode should be provided. For example, if a calculated velocity, acceleration, angular movement and/or distance traveled exceeds a predetermined threshold, then the processing unit 25 generates and sends an alert trigger signal to the one or more alert mechanisms 45 which causes the alert mechanisms 45 to generate and emit an appropriate alert signal or signals aimed at awakening the sleepwalking individual and possibly also the caregiver.

In one particular embodiment, a vibration threshold of 0.095 g with a band-pass filter response of 0.16 Hz-2.5 Hz, and tilt angle threshold of 0.110 g with a low-pass filter cutoff of 0.16 Hz is used to determine when an alarm should be triggered. It should be appreciated that this embodiment is only one exemplary embodiment and that other thresholds and frequency domain cutoffs, or multiples of these can be employed to characterize the motion of the subject, or to discriminate important motions. A commercially available two-axis MEMS accelerometer like the Analog Devices Model ADXL 320 may be used for this, utilizing the mentioned vibration activity and tilt thresholds on each axis and integrating time above threshold per unit time for both axes combined. Certainly, as noted elsewhere herein, a wide variety of sensors may be used, for example: a single to multi-axis accelerometer, or tilt sensor(s), or gyroscope(s).

Furthermore, the values used to determine when an alarm should be triggered could be selectable based on a worn location of the monitoring unit 10 and/or expected in-bed activity level and/or expected in-bed activity duration. In-bed motions described for instance with the accelerometer detection method described immediately above are typically of limited duration and settle within approximately 15 seconds. Thus, persistent or maintained motions for longer than a threshold in the range of 15-30 seconds are suspicious and therefore indicative of out-of-bed activity. In other words, an alarm may be triggered when certain motion data is determined to exceed a threshold value for more than a predetermined amount of time. Alternatively, an alarm may be triggered when certain motion data is determined to exceed a threshold value at least a certain number of times within a predetermined time period. In addition, the values used to determine when an alarm should be triggered could be learned by the system by marking instances of sleepwalking observed by a caregiver into the base unit 15 and/or caregiver unit 20. This marking could be done as the sleepwalking episodes occur or later by entering time(s) into the base unit 10 and/or caregiver unit 20.

Moreover, accelerometers and/or gyroscopes can also determine precise locations and/or routes, given the motion of a wearer of the monitoring unit 10. This inertial data can also be used to train the monitoring unit 10 and/or base unit 15 to distinguish particular egress routes from the sleeping location, or identify and keep the wearer out of danger locations (e.g. window vs. door route, or bathroom vs. furnace room). The inertial data can thus be used to characterize potentially dangerous or aggravated motions from relatively benign or typical behaviors.

In addition, in response to such a determination, the processing unit 25 may send a wireless alert trigger signal to the base unit 15 through the wireless communications device 35 and the antenna 40. The wireless alert trigger signal will be received by the antenna 70 and the wireless communications device 65 of the base unit 15 and thereafter will be transmitted to the processing unit 55 of the base unit 15. In response thereto, the processing unit 55 will send an alert trigger signal to the one or more alert mechanisms 75 which causes the alert mechanisms 75 to generate and emit an appropriate alert signal or signals, in the manner described above, aimed at awakening the sleepwalking individual and possibly also the caregiver. Furthermore, when the base unit 15 receives the wireless alert trigger signal from the monitoring unit 10, it also preferably sends a wireless alert signal to the caregiver unit 20, in the manner described elsewhere herein, to cause the caregiver unit 20 to generate an appropriate alert signal or signals. In addition, the base unit 15 may also send a signal through the power lines of the structure 6 in which the individual and the caregiver are located using X10 or similar technology which causes a device coupled to the power lines, such as the lights, a television, a stereo system, a clock radio or the like, to be turned on to try to awaken one or both of the individual and the caregiver.

Figure 5:
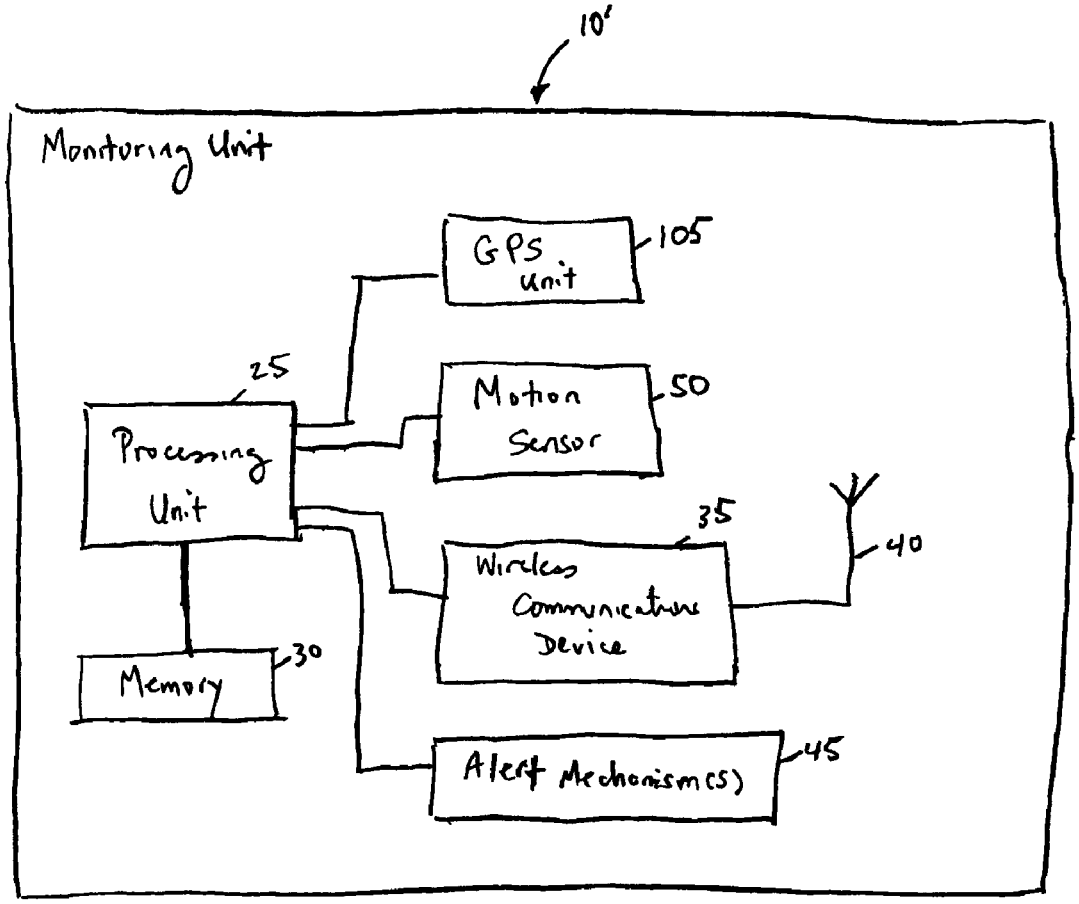
FIG. 5 is a block diagram of an alternate embodiment of a monitoring unit forming a part of a system that employs GPS for detecting possible sleepwalking episodes.

According to an alternative embodiment of the invention, proximity sensing to detect possible sleepwalking episodes is performed using global positioning system (GPS) information. In particular, in this embodiment, a monitoring unit 10' as shown in FIG. 5 is provided. As seen in FIG. 5, the monitoring unit 10' is similar to the monitoring unit 10 shown in FIG. 2 in that it includes the processing unit 25, the memory 30, the wireless communications device 35, the antenna 40, the alert mechanisms 45 and the motion sensor 50 as described in connection with FIG. 2. However, the monitoring unit 10' also further includes a GPS unit 105 which includes a receiver that allows the monitoring unit 10' to interact with and receive global positioning information from the GPS satellite system that indicates the current positional coordinates of the GPS unit 105 and thus the monitoring unit 10'. As is known in the art, the GPS satellite system is worldwide radio-navigation system formed from a constellation of 24 satellites and their ground stations.

In operation, global positioning information received by the GPS unit 105 is wirelessly transmitted to the base unit 15 in the manner described elsewhere herein (for this purpose, the wireless communications device 35 is capable of transmitting a signal having sufficient strength to reach the base unit 15 from location within the structure that may be relatively far from the base unit 15). The base unit 15 is preprogrammed with global positioning information that indicates its current location within the structure 6. Upon receipt of the global positioning information from the monitoring unit 10', the base unit 15 (and in particular the processing unit 55 thereof) compares the stored global positioning information that indicates the current location of the base unit 15 to the received global positioning information that indicates the current location of the monitoring unit 10'. If the difference between the two positions is determined to be greater than some predetermined threshold value (i.e., some predetermined distance), then the processing unit 55 considers the monitoring unit 10' to have moved far enough away from the base unit 15 to warrant an alarm (i.e., a sleepwalking episode may be occurring), and, in response thereto, the processing unit 55 sends an alert trigger signal to the one or more alert mechanisms 75 which causes the alert mechanisms 75 to generate and emit an appropriate alert signal or signals aimed at awakening the sleepwalking individual and possibly also the caregiver. In addition, the processing unit 55 may also cause appropriate signals to be generated and sent to cause one or both of the monitoring unit 10' or the caregiver unit 20 to generate alerts as described elsewhere herein. Also, the base unit 15 may also send a signal through the power lines of the structure 6 in which the individual and the caregiver are located using X10 or similar technology which causes a device coupled to the power lines, such as the lights, a television, a stereo system, a clock radio or the like, to be turned on to try to awaken one or both of the individual and the caregiver. Preferably, the GPS based proximity monitoring just described is implemented in conjunction with the motion or movement based monitoring described elsewhere herein.

Figure 6:
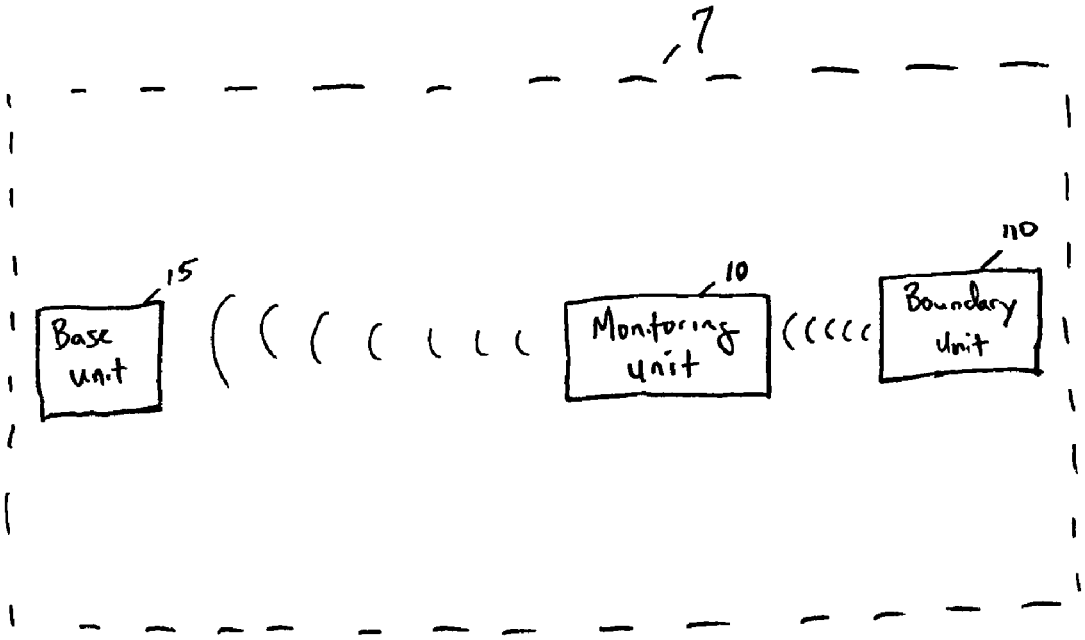
FIG. 6 is a block diagram of the room where an individual being monitored sleeps that forms a part of an alternative embodiment of a system for detecting sleepwalking episodes according to the present invention.

According to an alternative embodiment of the invention, the proximity of the monitoring unit 10 to certain boundary positions of the room 7 (or some other location within the structure 6 where the individual being monitored sleeps) is monitored to determine when alerts of possible sleepwalking episodes should be given. In one particular implementation, as shown in FIG. 6, one or more boundary units 110 are provided at certain boundary positions of the room 7, such as at a door to the room 7. The boundary units 110 emit a low strength wireless beacon signal which will received by the monitoring unit 10 only when the monitoring unit 10 is within a predetermined distance from the boundary unit 10 (and thus the boundary of the room 7). Receipt of the low strength wireless beacon signal by the monitoring unit 10 causes the monitoring unit 10 to initiate one or more alerts of a possible sleepwalking episode as described elsewhere herein (i.e., an alert generated by one or more of the monitoring unit 10, the base unit 15 and/or the caregiver unit 20 in the manners previously described). The one or more boundary units 110 may be a number (including only one) of discrete devices positioned at various locations in the room 7, or may be a device that includes a wire that emits the low strength beacon signal and that covers part or all of (i.e., surrounds) the boundary of the room 7. In either case, the idea is to monitor if and when the monitoring unit 10, and thus the individual wearing it, has approached the boundary of the room 7 as that is an indicator of a possible sleepwalking episode. Preferably, the boundary based proximity monitoring just described is implemented in conjunction with the motion or movement based monitoring described elsewhere herein.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims.

What is claimed is:

1. A system for detecting possible sleepwalking episodes of an individual, comprising:

a monitoring unit structured to be worn by the individual while the individual is sleeping, the monitoring unit having a first processing unit, a motion sensor in electronic communication with the first processing unit, and one or more monitoring unit alert mechanisms in electronic communication with the first processing unit and structured to generate a humanly perceptible alarm within the vicinity of the monitoring unit, the motion sensor generating one or more signals indicative of the movement of the individual, wherein the first processing unit causes a first humanly perceptible alarm to be emitted by the one or more monitoring unit alert mechanisms when the first processing unit determines that the one or more signals indicative of the movement of the individual indicate a possible sleepwalking episode; and a base unit positioned within an environment where the individual sleeps; wherein at least one of the monitoring unit and the base unit causes one or more humanly perceptible proximity based alarms to be emitted by the system when the monitoring unit is determined to be at least a certain distance away from the base unit.

2. The system according to claim 1, wherein the base unit includes a second processing unit and one or more base unit alert mechanisms in electronic communication with the second processing unit and structured to generate a humanly perceptible alarm within the vicinity of the base unit, wherein the first processing unit is adapted to cause the monitoring unit to transmit a wireless alert signal to the base unit when the first processing unit determines that the one or more signals indicative of the movement of the individual indicate a possible sleepwalking episode, and wherein in response to receipt of the wireless alert signal the second processing unit is adapted to cause the one or more base unit alert mechanisms to emit a second humanly perceptible alarm.

3. The system according to claim 2, further comprising a caregiver unit having a caregiver processing unit and one or more caregiver alert mechanisms in electronic communication with the caregiver processing unit and structured to generate a humanly perceptible alarm within the vicinity of the caregiver unit, wherein the second processing unit is adapted to cause a second alert signal to be transmitted to the caregiver unit in response to receipt of the wireless alert signal, and wherein in response to receipt of the second alert signal the caregiver processing unit is adapted to cause the one or more caregiver alert mechanisms to emit a third humanly perceptible alarm.

4. The system according to claim 1, wherein the first processing unit generates motion data based upon the one or more signals indicative of the movement of the individual, and wherein the first processing unit determines whether the one or more signals indicative of the movement of the individual indicate a possible sleepwalking episode based upon the motion data.

5. The system according to claim 4, wherein the first processing unit will determine that the one or more signals indicative of the movement of the individual indicate a possible sleepwalking episode when the motion data is determined to exceed a certain value.

6. The system according to claim 4, wherein the first processing unit will determine that the one or more signals indicative of the movement of the individual indicate a possible sleepwalking episode when the motion data is determined to exceed a certain value for more than a predetermined amount of time.

7. The system according to claim 4, wherein the first processing unit will determine that the one or more signals indicative of the movement of the individual indicate a possible sleepwalking episode when the motion data is determined to exceed a threshold value at least a certain number of times within a predetermined time period.

8. The system according to claim 4, wherein the motion data represents at least one of a distance traveled by the individual, a velocity of the individual, an acceleration of the individual, an angular movement of the individual and a location of the individual.

9. The system according to claim 1, wherein the monitoring unit includes a first wireless communications device and the base unit includes a second wireless communications device, wherein one of the first wireless communications device and the second wireless communications device emits a beacon signal and wherein the other of the first wireless communications device and the second wireless communications device is structured to receive the beacon signal, and wherein the at least one of the monitoring unit and the base unit determines that the monitoring unit is at least the certain distance away from the base unit when a signal strength of the beacon signal received by the other of the first wireless communications device and the second wireless communications device is determined to be at or below a predetermined value, the signal strength being indicative of a distance between the monitoring unit and the base unit.

10. The system according to claim 9, wherein the first wireless communications device emits the beacon signal and wherein the second wireless communications device is structured to receive the beacon signal.

11. The system according to claim 10, wherein the base unit includes a second processing unit and one or more base unit alert mechanisms in electronic communication with the second processing unit and structured to generate a humanly perceptible alarm within the vicinity of the base unit, and wherein the second processing unit is adapted to determine the signal strength of the beacon signal received by the base unit and cause the one or more base unit alert mechanisms to emit a first one or more of the one or more humanly perceptible proximity based alarms when the signal strength is determined to be at or below the predetermined value.

12. The system according to claim 11, wherein the second processing unit is adapted to cause the one or more base unit alert mechanisms to emit the first one or more of the one or more humanly perceptible proximity based alert signals alarms when the signal strength is determined to be about zero.

13. The system according to claim 11, wherein the second processing unit is adapted to cause the second wireless communications device to transmit a wireless alert signal to the first wireless communications device when the signal strength is determined to be at or below the predetermined value, and wherein in response to receipt of the wireless alert signal the first processing unit is adapted to cause the one or more monitoring unit alert mechanisms to emit a second one or more of the one or more humanly perceptible proximity based alarms.

14. The system according to claim 11, further comprising a caregiver unit having a caregiver processing unit and one or more caregiver alert mechanisms in electronic communication with the caregiver processing unit and structured to generate a humanly perceptible alarm within the vicinity of the caregiver unit, wherein the second processing unit is adapted to cause an alert signal to be transmitted to the caregiver unit when the signal strength is determined to be at or below the predetermined value, and wherein in response to receipt of the alert signal the caregiver processing unit is adapted to cause the one or more caregiver alert mechanisms to emit a second one or more of the one or more humanly perceptible proximity based alarms.

15. The system according to claim 14, wherein alert signal is transmitted to the caregiver unit in a wired fashion.

16. The system according to claim 14, wherein the caregiver unit includes a caregiver wireless communications device, wherein the alert signal is a wireless alert signal, and wherein second processing unit is adapted to cause the second wireless communications device to transmit the wireless alert signal to the caregiver wireless communications device when the signal strength is determined to be at or below the predetermined value.

17. The system according to claim 11, wherein the second processing unit is adapted to cause a power line signal to be transmitted over the power lines of a structure in which the base unit is located when the signal strength is determined to be at or below the predetermined value, the power line signal causing one or more devices coupled to the power lines to generate a human perceptible signal comprising one or both of noise and light.

18. The system according to claim 1, wherein the monitoring unit further includes a GPS unit, the GPS unit receiving global positioning information that indicates a current location of the monitoring unit, wherein the monitoring unit transmits the global positioning information to the base unit, and wherein the base unit determines whether the monitoring unit is at least a certain distance away from the base unit based upon the global positioning information.

19. The system according to claim 1, further comprising at least one boundary unit provided at least one boundary position of the environment, wherein the monitoring unit is determined to be at least a certain distance away from the base unit when the monitoring unit is within a second certain distance of the at least one boundary unit.

20. The system according to claim 19, wherein the at least one boundary unit emits a boundary signal, and wherein the monitoring unit is determined to be within the second certain distance when the monitoring unit is able to receive the boundary signal.

21. A method of detecting possible sleepwalking episodes of an individual, comprising:

generating a monitoring unit worn by the individual one or more signals indicative of the movement of the individual while the individual is sleeping;

determining whether the one or more signals indicative of the movement of the individual indicate a possible sleepwalking episode;

causing a first humanly perceptible alarm to be emitted by the monitoring unit if it is determined that the one or more signals indicative of the movement of the individual indicate a possible sleepwalking episode;

monitoring a proximity of the individual to a position within an environment where the individual sleeps; and causing one or more humanly perceptible proximity based signals alarms to be emitted when the individual is determined to be at least a certain distance away from the position.

22. The method according to claim 21, further comprising generating motion data based upon the one or more signals indicative of the movement of the individual, wherein the step of determines whether the one or more signals indicative of the movement of the individual indicate a possible sleepwalking episode is based upon the motion data.

23. The method according to claim 22, wherein the determining step will determine that the one or more signals indicative of the movement of the individual indicate a possible sleepwalking episode when the motion data is determined to exceed a certain value.

24. The method according to claim 22, wherein the determining step will determine that the one or more signals indicative of the movement of the individual indicate a possible sleepwalking episode when the motion data is determined to exceed a certain value for more than a predetermined amount of time.

25. The method according to claim 22, wherein the determining step will determine that the one or more signals indicative of the movement of the individual indicate a possible sleepwalking episode when the motion data is determined to exceed a threshold value at least a certain number of times within a predetermined time period.

26. The method according to claim 22, wherein the motion data represents at least one of a distance traveled by the individual, a velocity of the individual, an acceleration of the individual an angular movement of the individual, and a location of the individual.

27. The method according to claim 21, wherein the step of monitoring a proximity of the individual comprises wirelessly transmitting a beacon signal from one of the monitoring unit worn by the individual and a base unit located at the position, wirelessly receiving the beacon signal at the other of the monitoring unit and the base unit, and determining that the individual is at least the certain distance away from the position when a signal strength of the beacon signal received by the other of the monitoring unit and the base unit is determined to be at or below a predetermined value.

28. The method according to claim 27, wherein the step of monitoring a proximity of the individual comprises wirelessly transmitting the beacon signal from the monitoring unit, wirelessly receiving the beacon signal at the base unit, and determining that the individual is at least the certain distance away from the position when a signal strength of the beacon signal received by the base unit is determined to be at or below a predetermined value.

29. The method according to claim 21, wherein the step of monitoring a proximity of the individual to a position within an environment where the individual sleeps comprises employing global positioning to monitor a location of the individual.

30. The method according to claim 21, wherein the step of monitoring a proximity of the individual to a position within an environment where the individual sleeps comprises monitoring whether the individual is within a certain distance of at least one boundary unit provided at least one boundary position of the environment.

* * * * *